United States Patent [19]

Pardini

[11] Patent Number: 4,616,198

[45] Date of Patent: Oct. 7, 1986

[54] CONTACT ARRANGEMENT FOR A CURRENT LIMITING CIRCUIT BREAKER

[75] Inventor: Franco P. Pardini, Milan, Italy

[73] Assignee: General Electric Company, New York, N.Y.

[21] Appl. No.: 754,042

[22] Filed: Jul. 11, 1985

[30] Foreign Application Priority Data

Aug. 14, 1984 [IT] Italy ..... 22405 A/84

[51] Int. Cl.[4] ..... H01H 75/00; H01H 77/00; H01H 83/00

[52] U.S. Cl. ..... 335/16; 335/17

[58] Field of Search ..... 335/16, 147, 195, 17; 200/147 R

[56] References Cited

U.S. PATENT DOCUMENTS 3,517,356 6/1970 Hanafusa ..... 335/16

3,764,946 10/1973 Mostosi ..... 335/195

4,292,611 9/1981 Bresson et al. ..... 335/16 X 4,301,342 11/1981 Castonguay et al. ..... 335/17 X 4,470,028 9/1984 Vayre et al. ..... 335/16

*Primary Examiner*—L. T. Hix

*Assistant Examiner*—Brian W. Brown

*Attorney, Agent, or Firm*—Richard A. Menelly; Walter C. Bernkopf; Fred Jacob

[57] ABSTRACT

A contact arrangement for a current limiting circuit breaker wherein two movable contact arms are interconnected by means of a pair of connecting arms and a manually operable push rod. An electromagnet is operatively coupled with one of the contact arms for holding in an open condition when the electromagnet is de-energized. The disclosed contact arrangement allows the circuit breaker to be multifunctionally employed as an integrated combination motor starter.

10 Claims, 6 Drawing Figures

CONTACT ARRANGEMENT FOR A CURRENT LIMITING CIRCUIT BREAKER

BACKGROUND OF THE INVENTION

The invention relates to current limiting circuit breakers having contact arms that are arranged for mutual electrodynamic repulsion independent of the operating mechanism upon occurrence of a short circuit current fault. Some means must be provided to close the circuit breaker contacts after the fault has cleared, as well as to visually indicate the condition of the contacts so that an operator could observe whether the contacts are either open or closed without having to disassemble the breaker housing. It is also advantageous, with state-of-the-art circuit breakers, to employ two pairs of circuit interrupting contacts to interrupt the current with the formation of a separate pair of arcs and a separate pair of arc chutes for extinguishing the arcs.

SUMMARY OF THE INVENTION

One object of the invention is to provide two pairs of circuit interrupting contacts operable by means of short circuit current to open both contact pairs independently of the operating mechanism.

A further object is to provide an indicating arrangement for visual indication of the open or closed conditions of the contacts.

A further object of the invention is to provide a contact arrangement wherein contact separation is provided manually. Another object of the invention is to provide at least one pair of circuit interrupting contacts within a current limiting circuit breaker to allow the breaker to operate as an integrated combination motor starter by means of a remotely operable electromagnet.

DESCRIPTION OF THE PREFERRED EMBODIMENT

Figure 1:
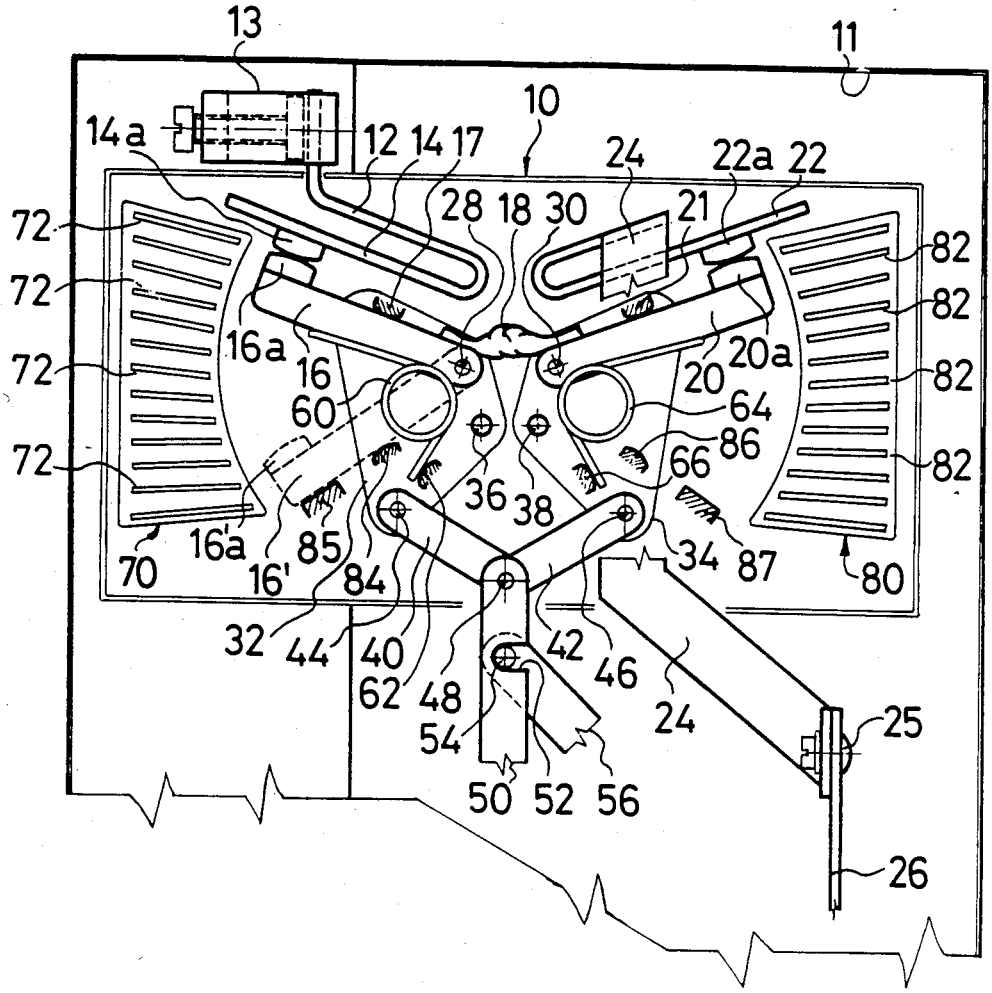
FIG. 1 is a side view of the current limiting contact arrangement according to the invention.

FIG. 1 contains a circuit breaker module 10 which generally houses the circuit breaker components of the circuit breaker of the invention and is enclosed within an insulative housing 11. Electrical connection is made with the module 10 by means of a conductor 12 which connects between a line terminal 13 and a first fixed contact arm 14 which supports a first fixed contact 14*a*. A first movable contact arm 16 abutting a stop 17 supports a first movable contact 16*a* which conducts current through a flexible braid 18 to a second movable contact arm 20, abutting a stop 21, and carrying a second movable contact 20*a*. The current transports through a second fixed contact 22*a* and a second fixed contact arm 22 out to a load terminal screw 25 and load conductor 26 over conductor 24. The two movable contact arms 16, 20 are rotatably mounted within the module 10 by means of pivots 28, 30 attached to first and second levers 32, 34 which in turn are rotatably mounted within the module by means of pivots 36 and 38. The movable contact arms 16, 20 are free to rotate independently of levers 32, 34 upon occurrence of a short circuit current which sets up opposing electrodynamic repulsion fields between first movable contact arm 16 and first fixed contact arm 14 causing the first movable contact arm and first movable contact to move to the open position against stops 84, 85 as indicated in phantom, respectively. The second movable contact arm 20 is also free to rotate against stops 86, 87 in a similar manner. The first movable contact arm return spring 60 is placed between a retainer 62 on the first lever 32 to bias the first movable contact arm in a closed position and to hold the first movable contact 16*a* against the first fixed contact 14*a* for good electrical transport therebetween. The second movable contact arm return spring 64 is placed between a retainer 66 on the second lever 34 to bias the second movable contact arm in a closed position and to hold the second movable contact 20*a* against the second fixed contact 22*a* for good electrical transport therebetween. The first and second levers 32, 34 are caused to rotate about their pivots 36, 38 by action of a push rod 50 which pivotally connects with a pair of connecting rods 40, 42 by means of pivot 48. The connecting rods in turn are pivotally connected to the first and second levers by means of pivots 44 and 46 respectively. The push rod 50 is manually operated by means of an operating mechanism (not shown) through a rod 56 which is operably connected with the push rod by means of a slot 52 and a pin 54. As indicated in FIG. 1, a first arc chute 70 containing a plurality of arc plates 72 is arranged ahead of the first fixed and movable contacts 14*a*, 16*a* to cool and de-ionize any arc which occurs upon their separation and a second chute 80 is arranged ahead of the second fixed and movable contacts 22*a*, 20*a* consisting of a plurality of arc plates 82 to cool and de-ionize any arc which occurs upon their separation.

Figure 2:
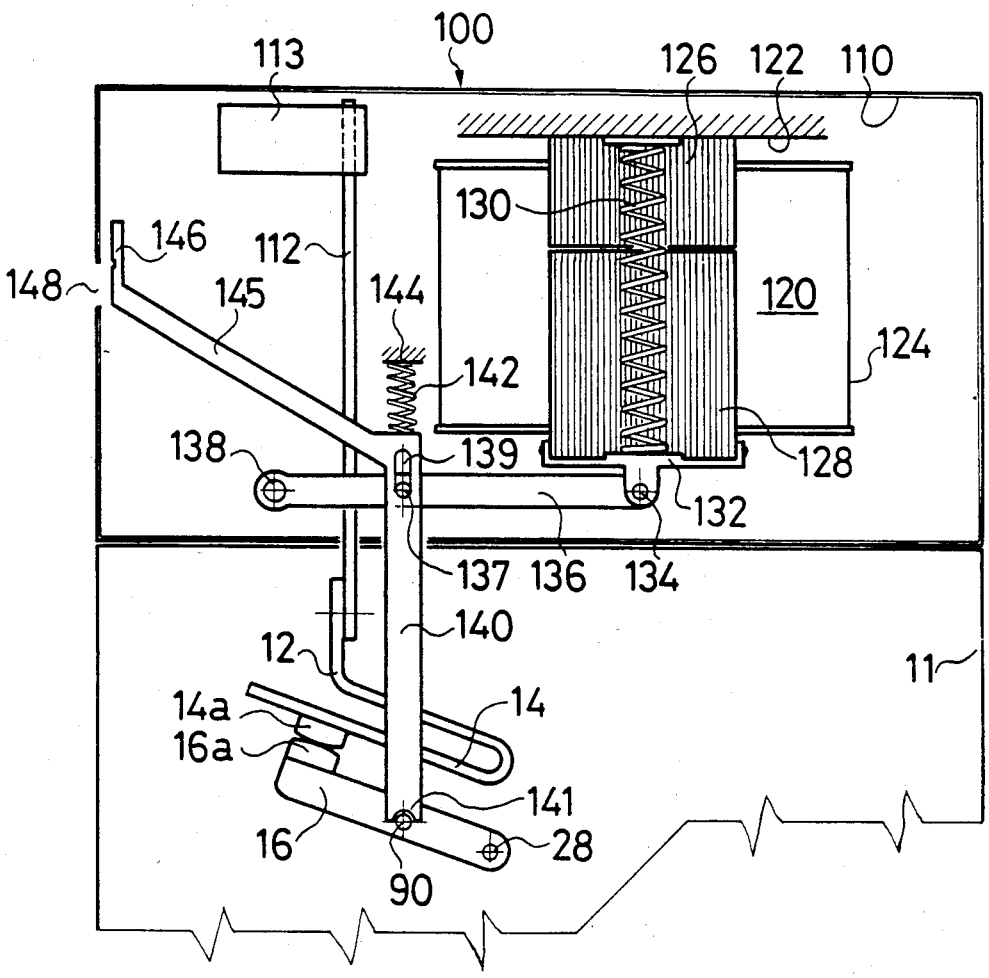
FIG. 2 is a side view of an alternative embodiment of the current limiting contact arrangement according to the invention arranged as an integrated combination motor starter.

An electromagnet 120 is shown in FIG. 2 within an electromagnet module 100 consisting of an isolating case 110 arranged above the circuit breaker housing 11. A terminal 113 is connected with the circuit conductor 12 by means of a conductor 112. The electromagnet 120 consists of a winding 124 arranged around a fixed core 126 fixedly attached to a support 122 and a movable armature 128 biased within the winding by means of a spring 130. A bracket 132 on the armature connects with an operating lever 136 by means of a pin 134 at one end and the other end of the lever is supported by means of a pin 138. Connection is made between a push rod 140 and the operating lever 136 by means of a pin 137 fixedly attached to the operating lever and captured within a slot 139 formed within the push rod 140. The push rod operates on one of the movable contact arms such as contact arm 16 by contacting a radius 141 formed at one end of the push rod with a pin 90 fixedly attached to a center region of the first movable contact arm to move the first movable contact arm downwardly against the return bias provided to the push rod 140 by means of the push rod return spring 142 anchored to a support 144. The electromagnet 120 can be arranged with respect to the winding 124 and the spring 130 to either move the operating lever 136 in a downward direction when energized to open the first fixed and movable contacts 14*a*, 16*a* or to move lever 136 to close the contacts when energized and when the push rod 50 has rotated levers 32, 34 to close the contact pairs 14*a*, 16*a* and 20*a*, 22*a* as shown in FIG. 1. A flag 146 supported on an extension 145 of the push rod 140 is arranged relative to a viewing window 148 to indicate the open and closed conditions of the movable contact arm as well as of the contacts. In the arrangement depicted in FIG. 2 the spring 130 is arranged to hold the operating lever 136 downward forcing pin 137, push rod 140 and first movable contact arm 16 in a downward direction to separate contacts 14*a*, 16*a* as soon as the winding 124 becomes de-energized.

Figure 3:
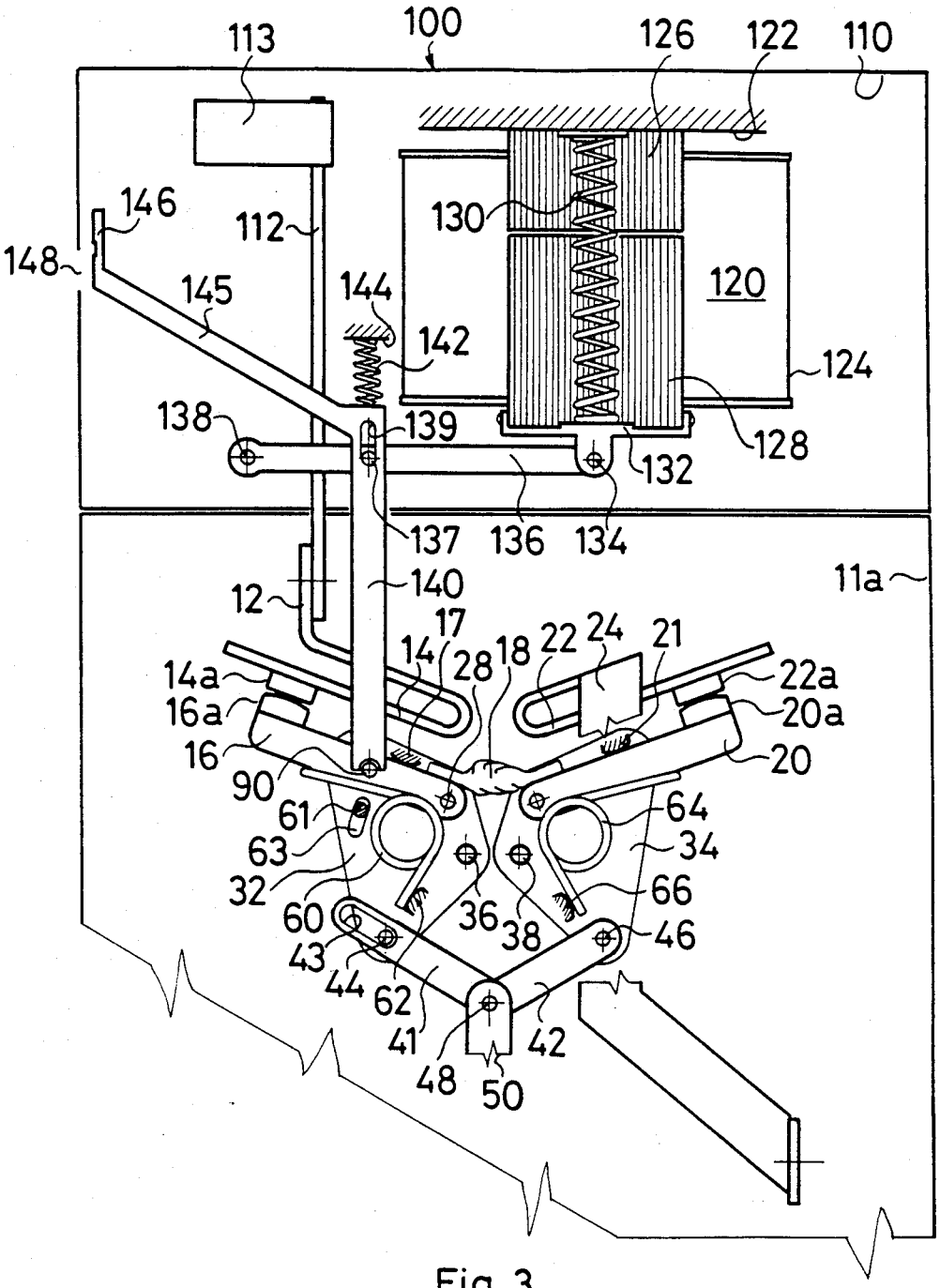
FIG. 3 is a side view of a further embodiment of the current limiting contact arrangement according to the invention.

When the electromagnet 120 is de-energized, springs 130, 142 push the rod 140 against pin 90 of contact arm 16 keeping the contact pair 14*a*, 16*a* open. As the push rod 50 is upwardly displaced making levers 32, 34 rotate to close the contact pairs 14*a*, 16*a*, and 20*a*, 22*a*, it is opposed by springs 130, 142. Push rod 50 is moved by means of a circuit breaker operating mechanism (not shown). When the operating force of the overcenter spring is not sufficient to overcome the force of springs 130, 142 the operation of push rod 50 is impaired and additional force is required from the operating mechanism. This is provided by the embodiment depicted in FIG. 3 wherein the rotating movement of lever 32 is prevented by means of a guide pin 61 fastened to the housing sidewall 11*a* within slot 63 in lever 32 whereby the upward displacement of the push rod is not opposed by springs 130, 142. Under short circuit conditions, contact arms 16, 20 are allowed to move under electrodynamic repulsion forces. The circuit breaker contact arrangement similar to that of FIG. 1 is operatively connected with an electromagnet module 100 similar to that shown in FIG. 2 which is arranged to hold the armature 128 against the fixed core 126 as long as the winding 124 is energized. Once the winding becomes de-energized the armature is forced downward under the urgence of spring 130 to separate the contacts 14*a*, 16*a*. Thus the contacts 14*a*, 16*a* are capable of becoming separated upon occurrence of a short circuit current as described earlier as well as by de-energizing the winding 124. This arrangement differs somewhat from that depicted in FIGS. 1 and 2 by the provision of the slot 63 and by means of a slot 43 formed in the connecting rod 41 which joins the push rod 50 to the first lever 32 by means of a pin 44 whereby the first lever 32 cannot be rotated by the downward displacement of the push rod. When the push rod 50 is displaced in the downward direction pulling connecting rod 42 and rotating the second lever 34 clockwise around its pivot 38, the second movable contact arm is pulled by stop 21 away from the second movable contact 20*a* is separated from the second fixed contact 22*a* to interrupt the series current flow through the circuit. The downward movement of the push rod 50 moves connecting arm 41 along slot 43 without rotating the first lever 32 in a counterclockwise opening direction due to the lost motion within slots 43 and 63. However, when the push rod 50 is displaced in the upward direction, pin 44 within slot 43 forces lever 32 to move slightly in a clockwise closing direction to assure a sufficient closing force on contacts 14*a*, 16*a*. It is thus seen that the contacts 14*a*, 16*a*, 20*a*, 22*a* can be opened by electrodynamic repulsion upon the occurrence of a short circuit while contacts 14*a*, 16*a* can also be opened by the action of the electromagnet 120. Both contacts can be closed by the operation of the electromagnet as well as by the operation of the push rod 50, but only the contacts 20*a*, 22*a*, can be opened by the push rod for the reasons given earlier.

Figure 4:
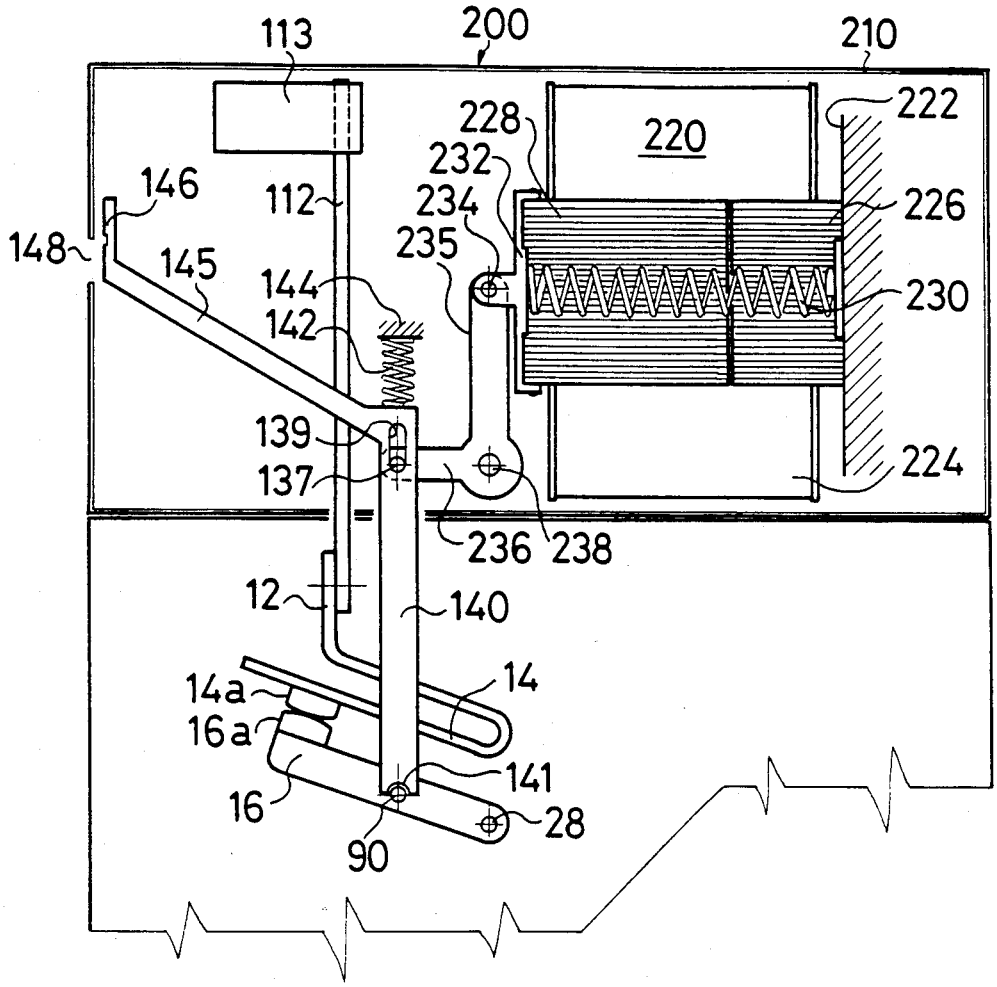
FIG. 4 is a side view of a still further embodiment of the contact arrangement according to the invention.

FIG. 4 shows a contact arrangement similar to that depicted in FIG. 2 with the electromagnetic module 200 arranged above the circuit interrupter insulative housing and with a terminal 113 connecting with the first fixed contact arm 14 by means of a conductor 112 and a conductor 12. Electrical connection through the circuit is provided by means of the first fixed and movable contacts 14*a*, 16*a* and the first movable contact arm 16 pivotally arranged for opening the contacts by means of pivot 28. The contacts are capable of electrodynamic separation by transport of short circuit current through the first fixed contact arm 14 and the first movable contact arm 16 in opposite directions. The contacts can also be opened and closed by means of push rod 140 which contacts pin 90 centrally located on the movable contact arm 16 by means of the radius 141 formed at the end of the push rod in the manner described earlier with reference to FIG. 2. A flag 146 connects with the push rod by means of extension 145 and is similarly arranged relative to window 148 to indicate the open and closed conditions of the contacts. An electromagnet 220 consisting of a winding 224 arranged within an isolating case 210 around a fixed core 226 and a movable armature 228 controls the operation of the contacts by connection with the push rod by means of a bellcrank lever 236 which is pivotally arranged within the isolating case 210 by means of pivot 238. One end of the lever 236 is connected with the armature by means of a bracket 232, arm 235 and connector pin 234. The other end of the lever has a pin 137 fixedly attached to the lever and captured within a slot 139 formed within the push rod 140 as indicated. Energizing the winding 224 holds armature 228 in contact with the fixed core 226 against the bias provided by a spring 230 which is anchored to the support 222. When the winding 224 is de-energized, the armature 228 moves forward away from the fixed core 226 under the urgence of spring 230 causing arm 235 to rotate the lever 236 downward and forcing the push rod 140 to move the first movable contact arm downwardly to separate the contacts 14*a*, 16*a* independently of the position of the push rod. As soon as the winding is energized, the armature is electromagnetically drawn back within the winding compressing spring 230 and returning the contacts to a closed condition by forcing the push rod upward in cooperation with the push rod return spring 142 which is retained against stop 144. This arrangement not only allows the contacts to separate under short circuit conditions but also allows the contacts to be open and closed by means of the electromagnet 220 allowing the circuit interrupter to function as an integrated combination motor starter.

Figure 5:
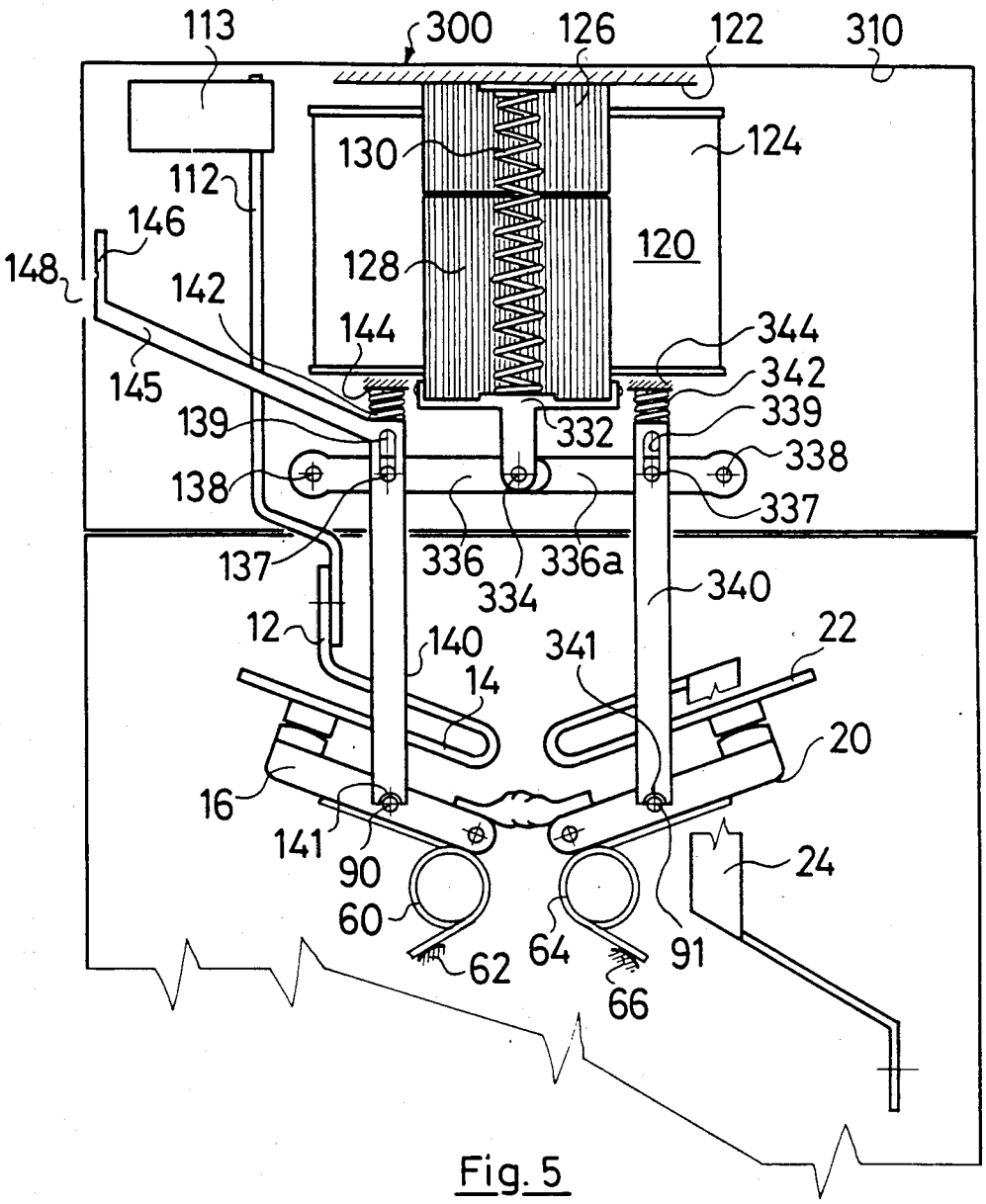
FIG. 5 is a side view of a current limiting contact arrangement according to the invention employing two pairs of separable contacts.

A contact arrangement is shown in FIG. 5 wherein both the first movable contact arm 16 and the second movable contact arm 20 are controllable by means of the electromagnet 120 within an electromagnetic module 300 which is enclosed within an isolating case 310. The contacts are electrically connected with an external circuit by means of terminal 113 which connects with the first fixed contact arm 14 by means of conductors 12 and 112 as indicated. As described earlier, a flag 146 visually accessed by means of a window 148 shows the conditions of the contacts. As also described earlier, both the first and second movable contact arms are capable of operation by electrodynamic repulsion against the holding force provided by their respective springs 60, 64 retained against stops 62, 66. In this embodiment, both movable contact arms are also capable of being operated by means of the electromagnet which is operatively connected to identical push rods 140, 340 which respectively contact pins 90, 91 on the movable contact arms by means of radii 141 and 341 formed on the ends of the push rods. The opposite ends of the push rods connect with operating levers 336, 336*a* by means of slots 139, 339 formed within the push rods and pins 137, 337 fixedly attached to the levers. The ends of the levers are supported by a pair of pins 138, 338 and the centers of the levers are connected with an armature bracket 332 by means of a common pivot 334. When the winding 124 is energized, the armature 128 is held against the fixed core 126 against the bias of spring 130. When the winding 124 is de-energized the armature 128 moves downward under the urgence of spring 130 forcing levers 336, 336*a* and push rods 140, 340 to move downward against the first and second movable contact arms 16, 20 separating their respective contacts independently of the condition of the push rods. When the winding 124 is again energized, the armature 128 is drawn back to the fixed core 126 carrying the levers 336, 336*a* and push rods 140, 340 in the upwards direction with the cooperation of springs 142, 342 held at their ends by means of supports 144 and 344. It is thus seen that the contacts are capable of electrodynamic separation under short circuit current conditions as well as being both opened and closed by means of the electromagnet 120 which is a desirable feature when the contact arrangement is used both as a circuit breaker and also as an integrated combination motor starter.

Figure 6:
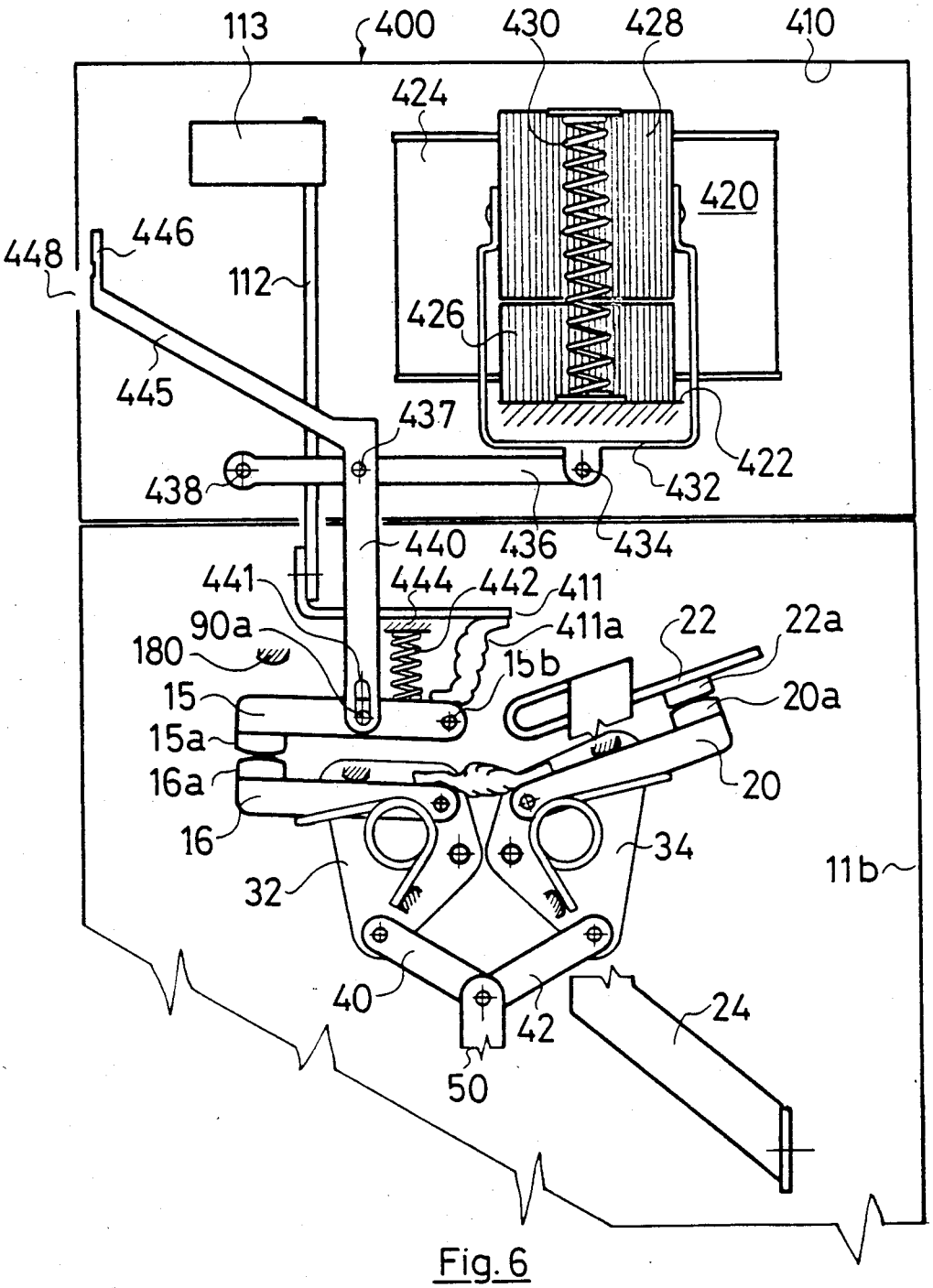
FIG. 6 is an alternate variation of the contact arrangement depicted in FIG. 1.

A further embodiment of the contact arrangement of the invention is shown in FIG. 6 wherein the electromagnetic module 400 within isolating case 410 is arranged above the housing sidewall 11*b*. Electrical connection with a pair of movable contact arms 15, 16 supporting movable contacts 15*a*, 16*a* is made by means of terminal 113, conductors 112, 411 and braid 411*a*. The contact arms are arranged to open by means of electrodynamic repulsion whereby the movable contact arm 15 is rotated about pivot 15*b* against a stop 180 in opposition to the bias of a contact spring 442 which is fixedly attached to a support 444 at one end and to the movable contact arm 15 at an opposite end. The position of the contacts is indicated by means of a flag 446 visible through a window 448 and operatively connected with the contact arm by means of extension 445, rod 440, slot 441 and pin 90*a* as indicated. The other pair of contacts 20*a*, 22*a* are carried by movable contact arm 20 and fixed contact arm 22, respectively. The movable contact arms 16, 20 are carried by first and second levers 32, 34 which in turn are pivotally connected with push rod 50 by means of connecting rods 40 and 42. When the push rod is moved upwards both movable contact arms and their respective contacts are moved to the upward direction to close the contacts. The contacts are opened by moving the push rod downwards. The electromagnet 420 with its winding 424 arranged around the fixed core 426 and armature 428 operates in the following manner. When the winding is energized, the armature pulls bracket 432 and lever 436, which are joined by means of pivot 434, downwards against the bias of spring 430 which is fixedly attached to support 422 at one end and to the armature at the other end. The movable contact arm 15 is allowed to be closed by the urgence of contact spring 442 and the movement of pin 90*a* within slot 441. However, when the winding is de-energized, the armature is moved upwards under the urgence of spring 430 which carries the lever 436 and rod 440 which is attached to the rod by pivot 437 upwards causing the lever to pivot counterclockwise about its pivot 438 and pulling the movable contact arm 15 and movable contact 15*a* into the open position. It is noted that the contacts cannot be manualy re-closed by operation of the push rod 50 until the winding 424 is again energized to allow the movable contact arm 15 and movable contact 15*a* to return to the downward contact closed position.

The fixed contact arm 22 of FIG. 6 can be replaced with a movable contact arm, similar to the contact arm 15, and the lever 436 and rod 440 can be arranged in a manner similar to that of FIG. 5, allowing both contact pairs to open when the electromagnet 420 is de-energized.

Having described my invention, what I claim as new and desire to secure by Letters Patent is:

1. A contact arrangement for a current limiting circuit breaker of the type consisting of two movable contacts on two movable contact arms electrically connected in series and arranged for electrodynamic repulsion with respect to two fixed contacts on two fixed contact arms upon short circuit current through said two movable and said two fixed contacts, comprising in combination;

a pair of operating levers connected with said movable contact arms and adapted for manual operation by means of a push rod, said push rod being pivotally connected with said operating levers by means of a pair of connecting rods;

a pair of contact springs, said contact springs being supported on said operating levers for holding said movable contact arms in a closed position with respect to said fixed contact arms;

an electromagnet operatively connected with one of said movable contact arms whereby said one movable contact arm is held in an open position when said electromagnet is de-energized and said one movable contact arm is returned to a closed position when said electromagnet is energized and said operating levers are arranged for contact closure;

said electromagnet comprising a fixed core and an armature arranged within a winding, said armature being operatively connected with one of said movable contact arms for operating said one movable contact arm against the bias of one of said contact springs; and an indicating flag operatively connected with one of said movable contact arms for providing visual indication as to the open and closed position of said movable contact arms.

2. The contact arrangement of claim 1 wherein said electromagnet further includes an armature sping for biasing said armature away from said fixed core when said winding is de-energized.

3. The contact arrangement of claim 1 wherein said armature is connected with said push rod by means of an armature lever whereby said push rod holds said one of said movable contact arms in an open position against the bias of said armature spring until said winding is energized to move said armature into proximity with said fixed core against said armature spring bias.

4. The contact arrangement of claim 1 wherein said electromagnet is operatively connected with both of said movable contact arms, whereby both of said movable contact arms return to a closed position when said electromagnet is energized and both of said operating levers are arranged for contact closure.

5. The contact arrangement of claim 4 wherein said armature is connected with both of said push rods by means of a pair of operating levers whereby said push rods hold both of said movable contact arms in an open position against the bias of said armature spring until said winding is energized to move said armature into proximity with said fixed core under said armature spring bias.

6. The contact arrangement of claim 1 wherein one of said operating levers is provided with a slot capturing a pin fastened to a portion of a housing sidewall and is connected to one of said connecting rods by means of a pin on said one operating lever, captured within a slot on said one connecting rod, for providing lost motion to said one connecting rod, whereby the movement of said one operating lever is prevented and said one movable contact arm is restrained from moving to a closed position by operation of said push rod until said electromagnet is de-energized.

7. The contact arrangement of claim 1 wherein at least one of said operating levers comprises a bell-crank lever pivotally connected with said armature at one end and slidably connected with said push rod at an opposite end.

8. The contact arrangement of claim 7 wherein said bell-crank lever is pivotally arranged intermediate both ends of said bell-crank lever for rotating in a first direction to move said push rod in a first direction and for rotating in a second direction to move said push rod in a second direction opposite said first direction.

9. A contact arrangement for a current limiting circuit breaker comprising:

a first movable contact arm carrying a first movable contact;

a second movable contact arm carrying a second movable contact;

said second movable contact arm being connected in series with a third contact arm carrying a third movable contact;

a fixed contact arm carrying a fixed contact, said first and second movable contact arms being arranged for electrodynamic repulsion, and said third movable contact arm and said fixed contact arm being arranged for electrodynamic repulsion;

a pair of operating levers connected with said second and third movable contact arms and adapted for manual operation by means of a push rod, said push rod being pivotally connected with said operating levers by means of a pair of connecting rods;

a pair of contact springs arranged for holding said second and third movable contact arms in closed position against said first movable contact arm and said fixed contact arm;

an electromagnetic operatively connected with said first movable contact arm whereby said first movable contact arm is held in an open position when said electromagnet is de-energized and said first movable contact arm returns to a closed position when said electromagnet is energized and said operating levers are arranged for contact closure;

said electromagnet including a fixed core, an armature and a winding, said armature being biased away from said core by means of an armature spring and being connected with said push rod by means of a push lever whereby said push rod holds said first movable contact in an open position against the bias of one of said contact springs until said winding is energized to move said armature into proximity with said fixed core against said contact spring bias; and an indicating flag connected with said push rod for providing visual indication as to the open and closed position of said first movable contact arm.

10. A contact arrangement for a current limiting circuit breaker comprising:

a first movable contact arm carrying a first movable contact;

a second movable contact arm carrying a second movable contact;

said second movable contact being connected with a third movable contact;

a fourth movable contact arm carrying a fourth movable contact, said fourth movable contact arm being arranged for electrodynamic repulsion between said first and second contact arms on one side and between said third and fourth movable contact arms on another side;

a pair of operating levers connected with said second and third movable contact arms and adapted for manual operation by means of a push rod, said push rod being pivotally connected with said operating levers by means of a pair of connecting rods;

a pair of contact springs for holding said second and third movable contact arms in a closed position against said first and fourth movable contact arms;

an electromagnet operatively connected with said first and fourth movable contact arms whereby said first and fourth movable contact arms are held in an open position wherein said electromagnet is de-energized and said first and fourth movable contact arms return to a closed position when said electromagnet is energized;

said electromagnet including a fixed core, an armature and a winding, said armature being biased away from said core by means of an armature spring and being connected with said push rods by means of a pair of levers whereby said push rods hold said first and fourth movable contacts in an open position against the bias of said armature spring until said winding is energized to move said armature into proximity with said fixed core against said armature spring bias; and an indicating flag connected with one of said push rods for providing visual indication as to the open and closed position of said first movable contact arm.

* * * * *